US006748759B2

(12) United States Patent
Wu

(10) Patent No.: US 6,748,759 B2
(45) Date of Patent: Jun. 15, 2004

(54) HIGH EFFICIENCY HEAT EXCHANGER

(76) Inventor: Ho-Hsin Wu, 40-1, Chang Chun Road, I-Lan (TW)

( * ) Notice: Subject to any disclaimer, the term of this patent is extended or adjusted under 35 U.S.C. 154(b) by 207 days.

(21) Appl. No.: 09/983,864

(22) Filed: Oct. 26, 2001

(65) Prior Publication Data

US 2003/0024692 A1 Feb. 6, 2003

(30) Foreign Application Priority Data

Aug. 2, 2001 (TW) ..... 090118869

(51) Int. Cl.[7] ..... F28D 5/00; F25B 47/00; A23C 3/04; F02M 31/00; F02M 23/14

(52) U.S. Cl. ..... 62/305; 165/911; 165/115; 62/277; 261/156; 261/157

(58) Field of Search ..... 62/305, 277, 279; 165/115, 911; 261/155, 156, 157

(56) References Cited

U.S. PATENT DOCUMENTS 2,723,540 A * 11/1955 Derr ..... 62/279
3,169,575 A * 2/1965 Engalitcheff et al. ..... 62/99
3,313,120 A * 4/1967 Kuss et al. ..... 62/188
3,691,786 A * 9/1972 Anderson et al. ..... 62/279
4,196,157 A * 4/1980 Schinner ..... 261/155
4,672,817 A * 6/1987 Croce ..... 62/183
6,213,200 B1 * 4/2001 Carter et al. ..... 165/285

* cited by examiner

*Primary Examiner*—William C. Doerrler
(74) *Attorney, Agent, or Firm*—Troxell Law Office PLLC

(57) ABSTRACT

A heat exchanger for a medium condenser having a plurality of vertical cooling fins having extra length extended both upwardly and downwardly from an ordinary portion of medium coil path for greatly increasing the cooling efficiency thereof, and a drip-drop type water feeding box for feeding water drops to a top of cooling fins densely but intermittently to let each of water drop remain in the space between opposite surfaces of adjacent cooling fins a short period of time and start to slide down the surface of a cooling fin as a next drop of water is delivered to provide enough time for evaporation so as to absorb a large quantity of latent heat and increase cooling efficiency.

8 Claims, 6 Drawing Sheets

HIGH EFFICIENCY HEAT EXCHANGER

FIELD OF THE INVENTION

The present invention relates to a heat exchanger for a medium condenser especially relates to a high efficiency heat exchanger in a combination of air cooling and water evaporating cooling system.

BACKGROUND OF THE INVENTION

A conventional heat exchanger of a medium condenser is usually in an air cooling or a water cooling type.

An air cooling heat exchanger, as shown in FIG. 1, comprises a plurality of vertical cooling fins, a plurality of medium pipes bored laterally through cooling fins and connected in series to a single medium coil, however the efficiency of this type is not high enough for reducing critical pressure of medium condensing therefor a long medium coil piping should be used for maintaining a high pressure therein.

While a water cooling heat exchanger may obtain a little better cooling efficiency, a large place is needed for a water shower cooling tower and a long piping system, and a large fan system is also needed. Therefore, the cost becomes high. Furthermore, a conventional water cooling system usually uses a plurality of water spray nozzles to spray water continuously onto the cooling fins under a pressure. Therefore an impact and splash will force the water to flow over the cooling fins quickly so that it can not provide an evaporating effect. Water cooling with a large quantity of circulating water requires a large collection pan and a powerful water pump for operating.

SUMMARY OF THE INVENTION

The present invention has been overcomes the aforesaid drawbacks.

A main object of the present invention is to provide a high efficiency heat exchanger having extra length cooling fins to increase air cooling efficiency.

Another main object is to provide a high efficiency heat exchanger by using a drip-drop type water feeding box to obtain a water evaporating effect therefore.

Also another main object is to provide a high efficiency heat exchanger wherein an extreme low temperature is reached in the system due to high cooling efficiency so that a plurality of medium coil sets connected in parallel can be applied to condense cooling medium in each medium coil set under a lower critical pressure.

Still another object is to provide a high efficiency heat exchanger having extra cooling zones to instead a cooling tower of a conventional water cooling system to cooling the circulated water for cost saving.

According to one aspect of the present invention, the high efficiency heat exchanger mainly comprising a plurality of vertical cooling fins having extra length extending both upwardly and downwardly from an ordinary portion of medium coil path for greatly increasing the cooling efficiency. Therefore, a drip-drop type water feeding box for feeding water drops to a top of cooling fins densely but intermittently to hold each water drop in the spacing between opposite surfaces of adjacent cooling fins a short period of time and start to slide down around the surface of a cooling fin as a next drop of water is delivered to provide enough time for evaporating so as to absorb a large quantity of latent heat for increasing cooling efficiency therefore.

DETAILED DESCRIPTION OF THE PREFERRED EMBODIMENT

Figure 1:
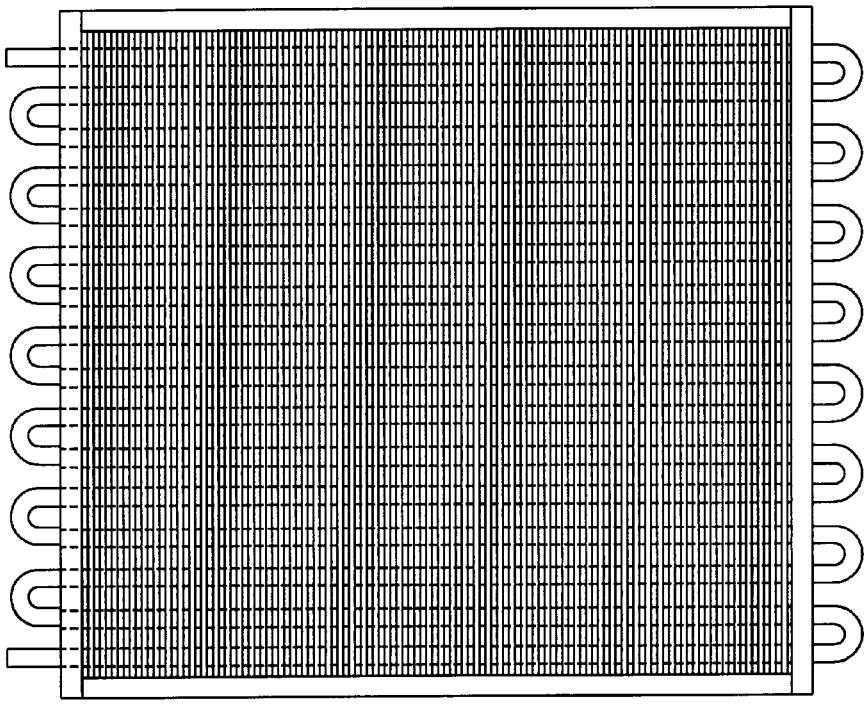
Prior Art FIG. 1
FIG. 1 shows a conventional air cooling heat exchanger.
Figure 2:
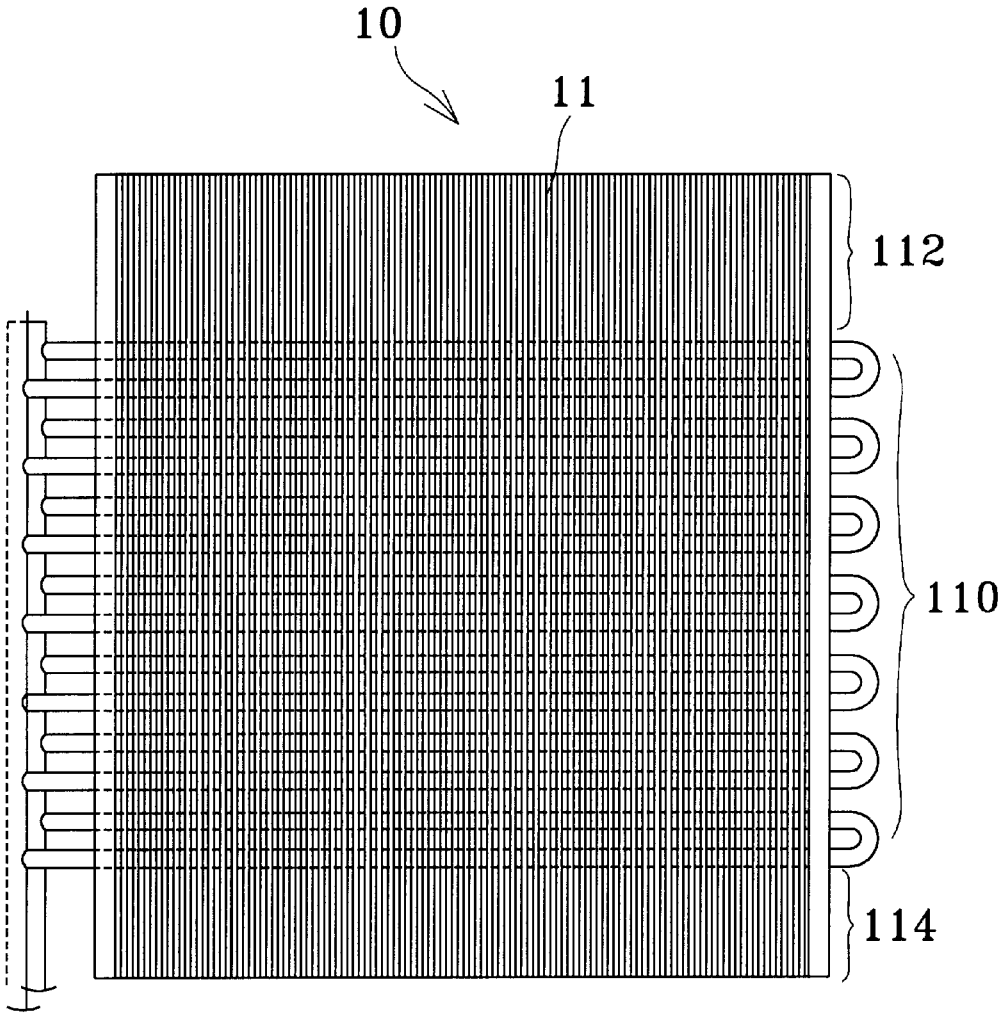
FIG. 2 showing extra cooling zones extended from an ordinary portion according to the present invention.

Please referring to FIG. 2, a heat exchanger 10 according to the present invention comprises a plurality of vertical cooling fins 11 having an ordinary portion 110 of medium coil path and essentially having an upside additional cooling zone 112 and a downside additional cooling zone 114 bath formed by extra length of cooling fins 11 extended upwardly and downwardly from the ordinary portion 110 to increase the radiating surface thereof so as to greatly raise the cooling efficiency therefore.

Figure 3:
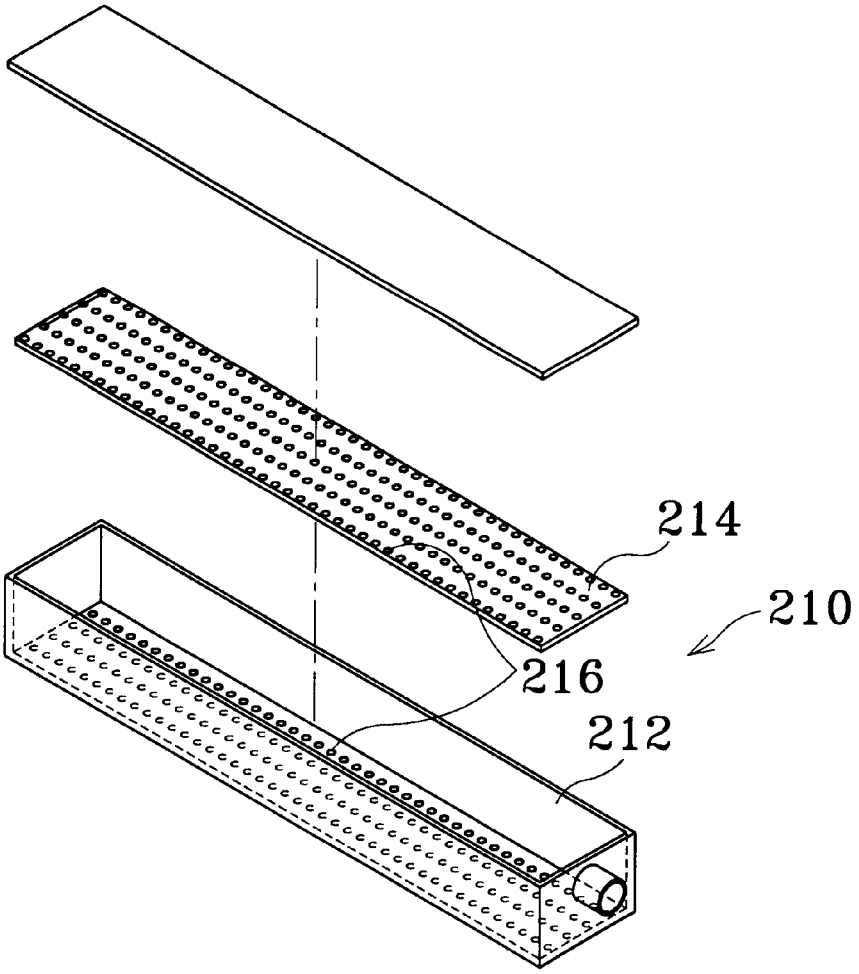
FIG. 3 is an explosive view of a drip-drop type water feeding box.

Referring to FIG. 3, an evaporative water feeding box 210 of drop-drip type comprises a bottom plate 212 having a plurality of small seeping holes 216 densely disposed to the bottom plate, and at least one layer 214 of horizontal partition plate also having small seeping holes 216 thereat to depart at least one upper section and one lower section. Therefore, as the water is circulated into the feeding box 210 from a top into the upper section it will seep into the lower section from each seeping holes 216 drop by drop, and then it will seep to a top of the cooling fins. Each drop seeps from each of the seeping holes gently, without impact and splash.

Figure 4:
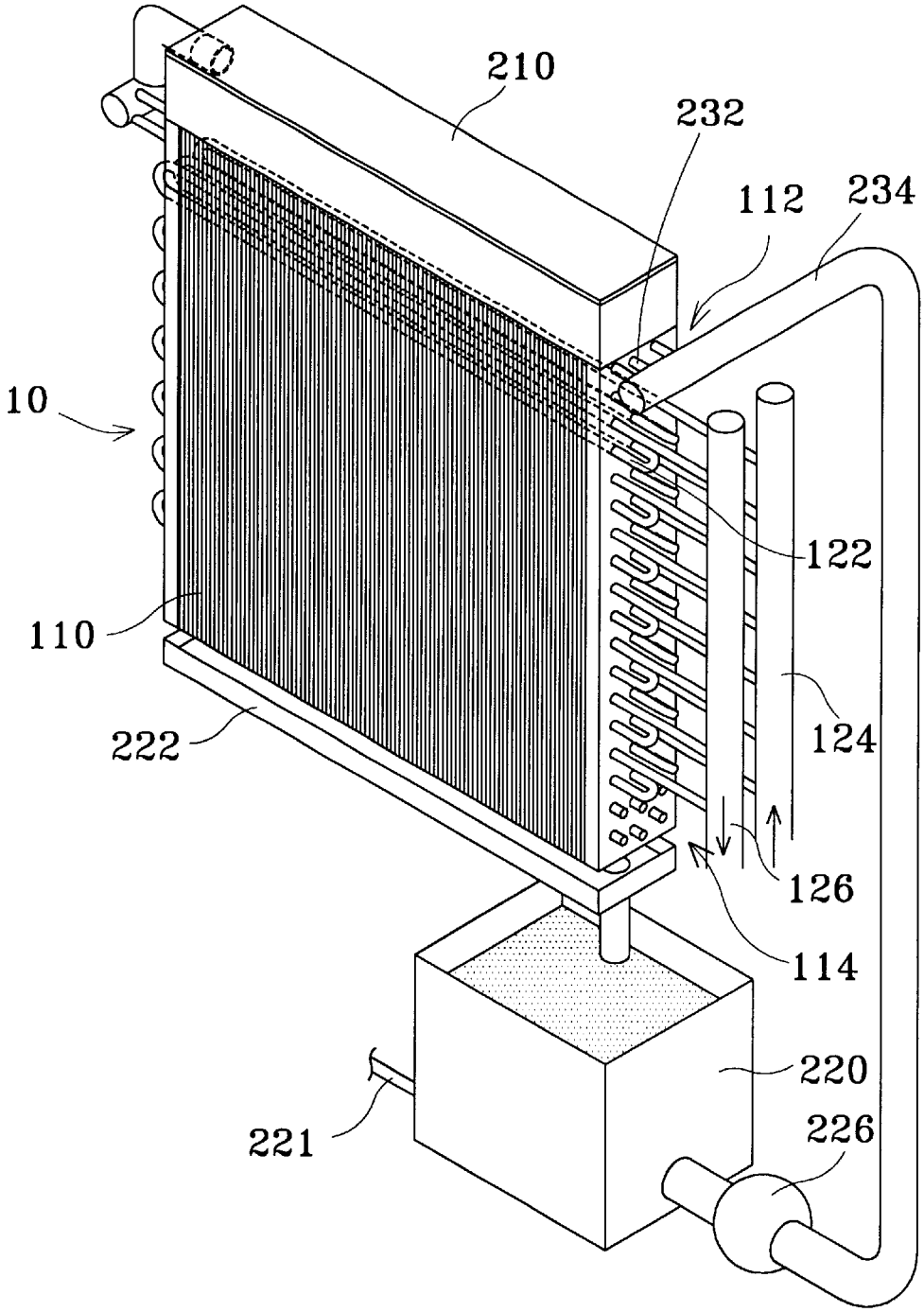
FIG. 4 shows medium coil sets according to the present invention.
Figure 5:
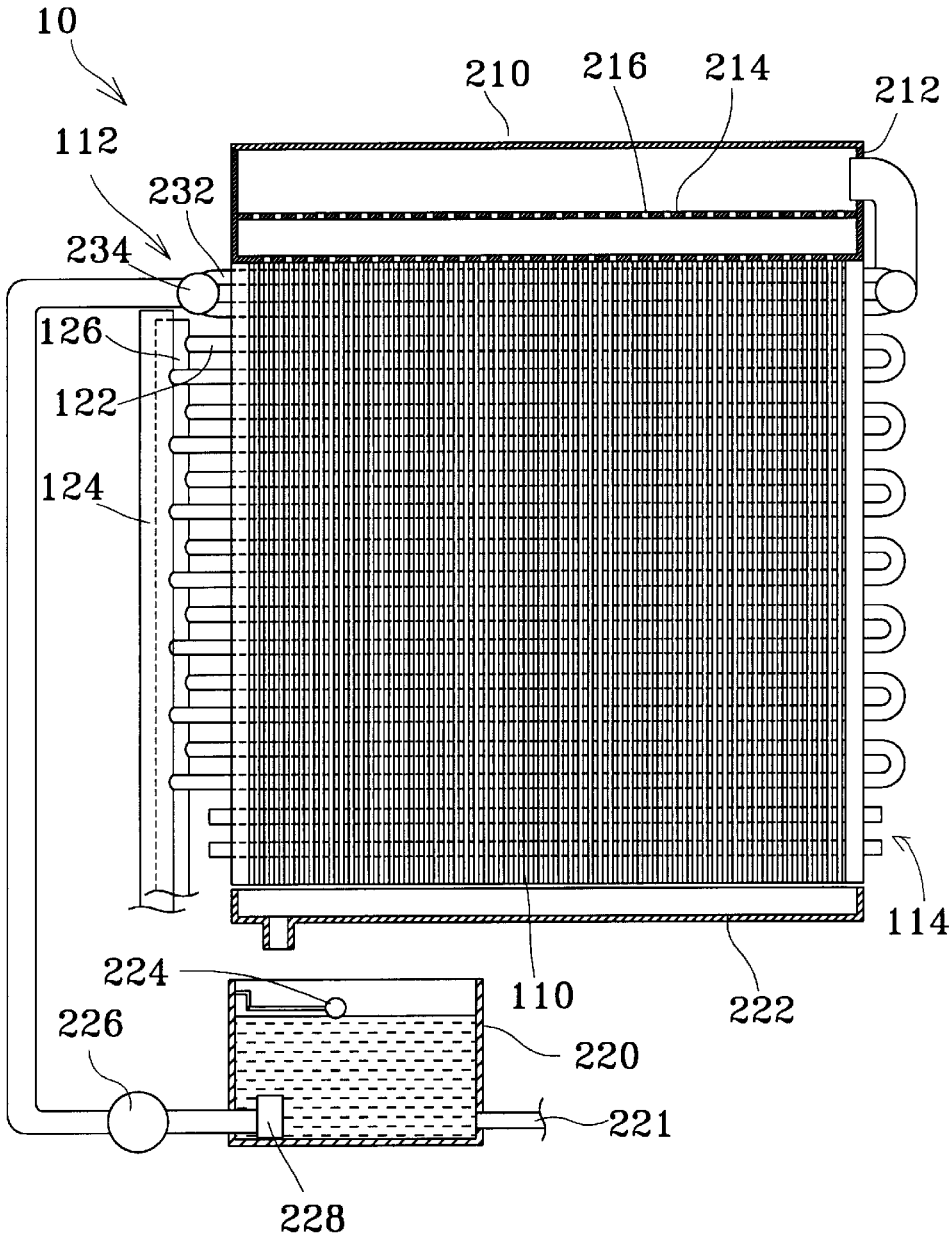
FIG. 5 shows a water supply system of the present invention.

FIGS. 4 and 5 show a medium intake manifold 124 receiving a pressurized vapor state medium from a medium compressor (not show) and distributing the vapor state medium into each set of medium coil 122 in parallel, in which the medium is condensed to a liquid state and collected by an outlet manifold 126 then guided into an evaporator (not show) through an expansion valve (not show); and a water circulating supply system comprising a water reservoir 220 having a sewage blow-down pipe 221 disposed at a side near to a bottom, a filter 228 (FIG. 5) disposed to a bottom ahead of a pump 226, and a floating balloon valve 224 (FIG. 5) connected to a city water piping to replenish water automatically while the water level in the reservoir 220 goes down to a predetermined low position due to a consumption of evaporating. The pump 226 is a speed adjustable pump connected between filter 228, water pipe 234 and a water coil 232 for setting a selective speed to supply a adequate quantity of water almost equal to the consumption water evaporated. The water coil 232 disposed at the upside additional cooling zone 112 is laterally bored through the cooling fins for cooling the water before using a residual water collecting channel 222 disposed under the downside additional cooling zone 114 to collect residual water therein and guide residual water back to the reservoir, while the residual water passes through the downside addition cooling zone 114 it will be cooled to a low temperature to insure there will be no temperature increase even during a long term running. A fan system (not shown) is included to blow off the heat and evaporated moisture away therefor.

Figure 6:
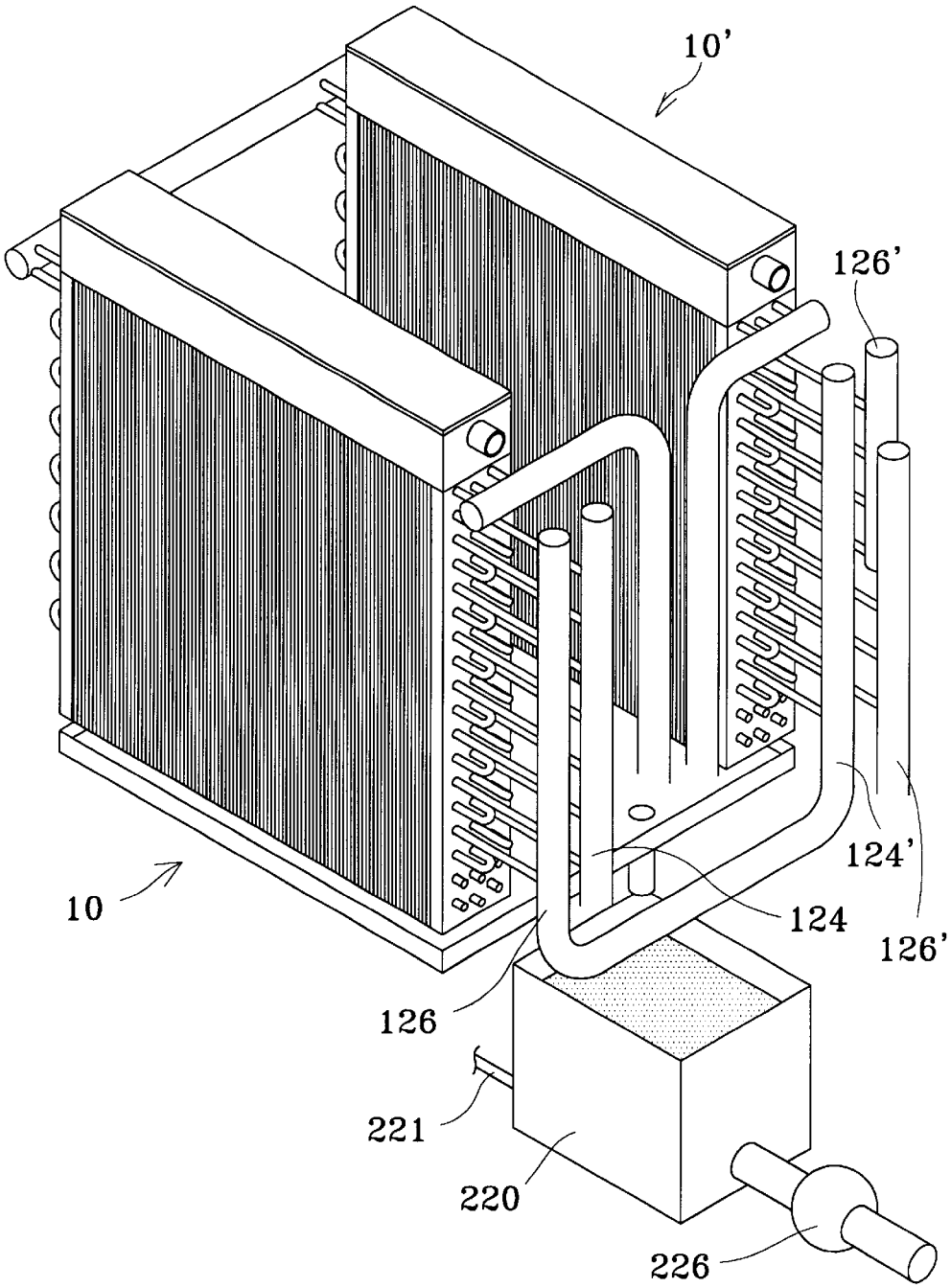
FIG. 6 shows a double row heat exchanger according to the present invention.

Referring to FIG. 6, a topical embodiment of a double row heat exchanger of the present invention is shown to include a first row heat exchanger 10 and a second heat exchanger 10' which a medium intake manifold 124 distributes the pressurized vapor state medium into a plurality of parallel connected coil sets from a medium compressor (not shown) for a first step condensing in the first row heat exchanger 10 and then guides the medium into another intake manifold 124' of second row heat exchanger 10' from an outlet manifold 126 of first row heat exchanger 10 for a second step condensing in the second row heat exchanger 10' and then collects the liquid state medium in an outlet manifold 126' to guide the medium to an evaporator (not shown) through an expansion valve (not shown) therefore.

It is to be understood that the drawings are designed for purposes of illustration only, and are not intended as a definition of the limits and scope of the invention disclosed.

What the invention claimed is:

1. A high efficiency heat exchanger for a medium condenser comprising:

a plurality of parallel vertical cooling fins evenly spaced and having extra length extending both upwardly and downwardly from an ordinary portion of said cooling fins forming an upside additional cooling zone and a downside additional cooling zone;

a plurality of medium coil sets connected in parallel and laterally bored through said ordinary portion of said cooling fins;

a drip-drop type water feeding box of an evaporative water supply system located over a top of said cooling fins for feeding water densely drop by drop onto a top edge of said cooling fins; and a fan system to deliver wind passing between said cooling fins for speeding the evaporation of evaporative water and blowing off heat and evaporated steam wherein said evaporative water supply system includes a residual water collecting channel, a water reservoir, a water pump, and a water coil, wherein said water coil pierces through said upside additional cooling zone of said cooling zone fins for cooling evaporative water before being guided to said feeding box.

2. The high efficiency heat exchanger according to claim 1, wherein said medium coil sets are connect to an outlet manifold for collecting a liquid state medium condensed in each coil set and guiding the liquid state medium into an evaporator through an expansion valve.

3. The high efficiency heat exchanger according to claim 1, wherein said drip-drop type water feeding box has a plurality of small seeping holes densely located in a bottom plate for feeding water drops therefrom.

4. The high efficiency heat exchanger according to claim 3, wherein said water feeding box further consist of at least one horizontal partition plate to provide at least one upper section and one lower section and having a plurality of small seeping holes for feeding water drops from said upper section to said lower section.

5. The high efficiency heat exchanger according to claim 1, wherein said water collecting channel is located below a bottom of said downside additional cooling zone of said cooling fins for collecting and feeding residual water back to said water reservoir, such that the residual water is cooled to a low temperature when passing through said downside additional cooling zone before dropping into said water collecting channel.

6. The high efficiency heat exchanger according to claim 1, wherein said water reservoir has a floating balloon valve connected to a city water pipe for automatically adding water to maintain water at a predetermined level.

7. The high efficiency heat exchanger according to claim 1, wherein said water pump is a speed adjustable water pump connected between said water reservoir and said water coil for controlling water supplied to said evaporative water feeding box through said water coil from said water reservoir in a selected quantity.

8. A high efficiency heat exchanger for a medium condenser of a refrigerating apparatus or an air conditioning apparatus comprising:

an upside additional cooling zone and a downside additional cooling zone having cooling fins for increasing cooling efficiency therefore;

an evaporative water supply system feeding water drops intermittently to said cooling fins without splashing such that the water remains on surfaces of said cooling fins to promote evaporation, wherein said upside additional cooling zone is utilized for cooling evaporative water before heat exchanging, and said downside additional cooling zone is utilized for cooling residual water after heat exchanging to insure that the temperature will not increase.

* * * * *